US006155898A

United States Patent [19]

Burns et al.

[11] Patent Number: 6,155,898

[45] Date of Patent: Dec. 5, 2000

[54] CONVERTIBLE AMPHIBIOUS SHOES FOR SWIMMING AND WALKING

[75] Inventors: Terrence R. Burns, Synder, N.Y.; Colleen M. Burns, Los Altos, Calif.; John C. Zoll, Rushford, N.Y.

[73] Assignee: Hollywood Hopeful Productions L.L.C., Synder, N.Y.

[21] Appl. No.: 09/548,107

[22] Filed: Apr. 12, 2000

Related U.S. Application Data

[60] Provisional application No. 60/129,604, Apr. 16, 1999.

[51] Int. Cl.[7] ..... A63B 31/08

[52] U.S. Cl. ..... 441/64

[58] Field of Search ..... D21/239; 441/61–64

[56] References Cited

U.S. PATENT DOCUMENTS

| | | | |
|---|---|---|---|
| 1,607,857 | 11/1926 | Zukal | 441/64 |
| 4,250,584 | 2/1981 | Korn | 9/304 |
| 4,264,994 | 5/1981 | Carbone | 441/64 |
| 4,752,259 | 6/1988 | Tackett et al. | 441/64 |
| 4,787,871 | 11/1988 | Tomlinson | 441/61 |
| 4,981,454 | 1/1991 | Klein | 441/62 |
| 5,041,039 | 8/1991 | Chang | 441/64 |
| 5,242,321 | 9/1993 | Gil | 441/64 |
| 5,292,272 | 3/1994 | Grim | 441/62 |
| 5,766,050 | 6/1998 | Maggi | 441/63 |

*Primary Examiner*—Ed Swinehart

*Attorney, Agent, or Firm*—Marianne Fuierer; Howard M. Ellis

[57] ABSTRACT

An amphibious shoe-like structure for swimming and walking having a shoe-like structure for receiving a foot and a fin structure that provides a fin blade surface that expands in the swimming mode and collapses in the walking mode to rest adjacent to the wearer's instep. The fin structure comprises a plurality of fin arms pivotally connected to the shoe-like structure for rotating the fin arms outwardly in the swimming mode position and for rotating the fin arms inwardly towards the instep of the wearer for a walking mode position. The fin arms diverge relative to one another when rotating outwardly and converge towards one another when rotating inwardly to rest adjacent to the wearer's instep. The fin structure further comprises a flexible web member that engages with the fins arms and is of the configuration and size to accomodate the area generated by the expanding and diverging side fin arms. The convertible amphibious structure further provides for a lock to lock the fin structure in the extended swimming mode position and for unlocking when converting into the walking mode position.

20 Claims, 8 Drawing Sheets

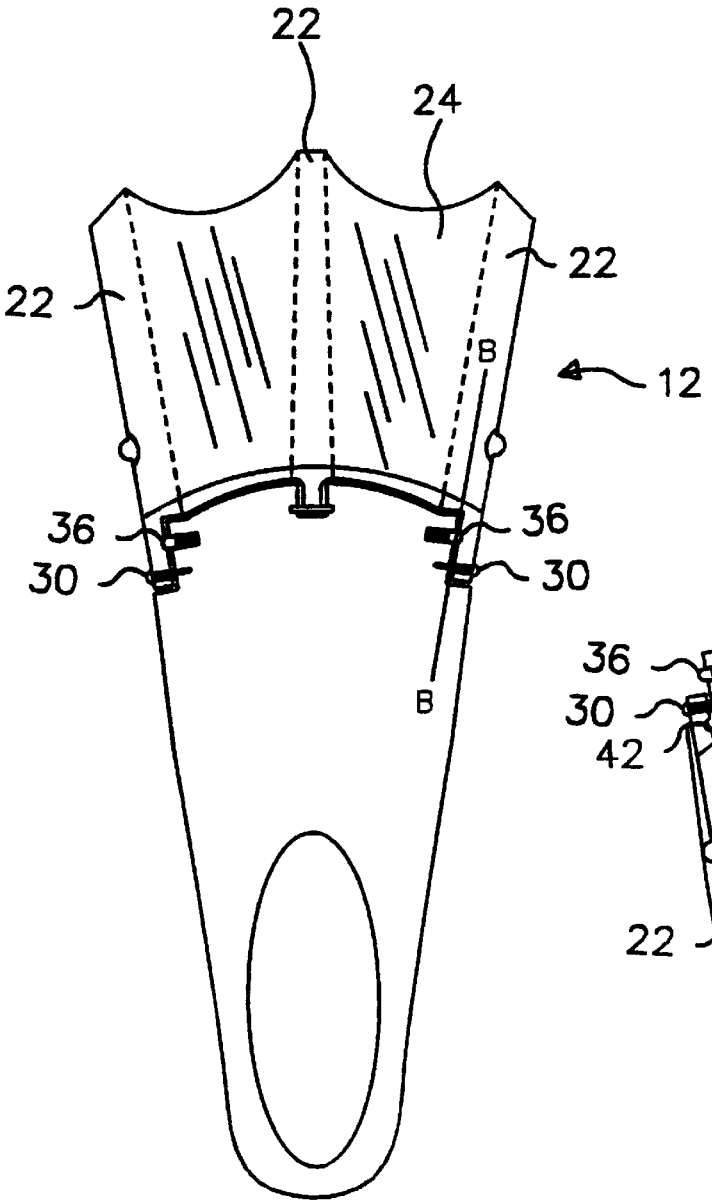
FIG. 5
FIG. 6
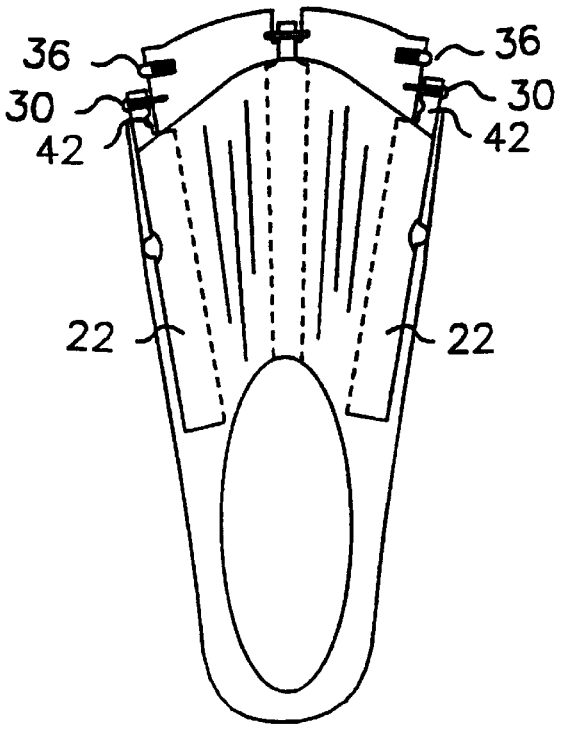

CONVERTIBLE AMPHIBIOUS SHOES FOR SWIMMING AND WALKING

CROSS REFERENCE TO RELATED APPLICATION

This application claims the benefit of U.S. Provisional Application Ser. No.: 60/129,604 filed on Apr. 16, 1999.

TECHNICAL FIELD

The present invention relates in general to multi-functional swimming shoes and in particular to amphibious shoes which may be used as walking shoes with easy convertibility to swim fins.

BACKGROUND OF THE INVENTION

Swim fins are devices that substantially increase the surface area of the naked foot thereby increasing the propulsive force of the legs. If used properly swim fins can conserve a diver's energy and facilitate underwater movement by becoming powerful extensions of a diver's body. In fact, fins can be so effective that arms and hands are not necessarily needed for propulsion when skin or scuba diving. However, few things feel as awkward as trying to walk while wearing swim fins due to the extended length of the fins which are cumbersome and can be potentially dangerous while walking.

To overcome this problem various swim fins have been proposed which include both a swimming and walking mode. For example, U.S. Pat. No. 5,292,272 (Grim) discloses an open-heel swim fin having a pivoting fin which pivots directly at the toe of the foot pocket. However, walking is still difficult because the non-collapsible fin blade in the retracted state is positioned at a 90° angle relative to the longitudinal axis of the foot which increases resistance when walking or wading in shallow water. Likewise, U.S. Pat. No. 4,981,454 (Klein) discloses an open-heel swim fin having a retractable fin blade that pivots near the arch of the foot. This pivoting allows for the fully expanded fin blade to rise above the instep of the foot where it is positioned adjacent and parallel to the leg. This prevents an awkward upright blade at the toe of the foot pocket but the large surface area of the fin blade is still in a cumbersome position which reduces flexibility while walking. U.S. Pat. No. 4,752,259 (Tackett et al.) discloses another embodiment of an open-heel model having a retractable fin wherein the surface area of the fin blade is bifurcated. The frontal end portion of the fin blade pivots upon itself either over or under the foot to facilitate walking. However, only a portion of the blade retracts leaving a substantial length of the fin blade extending longitudinally beyond the user's foot which impedes natural ambulation.

In order to avoid the disadvantages of the aforementioned shoe-fins, it has been proposed to attach a separate and removable fin blade to the shoe-like structure. For example, U.S. Pat. No. 5,041,039 (Chang et al.) discloses a detachable fin that is secured to the sole of the shoe structure by screw means. Likewise, U.S. Pat. No. 5,766,050 (Maggi) discloses a fin blade with a cup-like structure with internal locking means that fits over the toe area of a shoe-structure and seats thereto. However, in such shoe-fins the fins must be manually attached when needed and when not in use must still be transported by the user thereby defeating the purpose of easy convertibility between a swimming and walking mode.

Still further designs for swim fins have been disclosed in U.S. Pat. No. 5,242,321 (Gil) and U.S. Pat. No. 4,250,584 (Korn) wherein collapsible fins blades are provided for easy and compact transport and storage. However, these style are still not adaptable for walking, and therefore, cannot be converted between a swimming and walking mode.

Accordingly, there is a need for a more reliable amphibious swim shoe that can be worn comfortably on land with easy convertibility for swimming without the disadvantages of a cumbersome upright protruding fully extended fin blade, reduced flexibility of movement while walking, or transport of separate fin attachments for swimming.

SUMMARY OF INVENTION

Accordingly, it is a principal object of the present invention to provide an amphibious shoe that is lightweight, easy to pack and transport, attractive in a walking mode and which can easily be converted into a swimming mode.

Yet another object of the present invention is to provide an amphibious shoe wherein the surface area of the fin blade is reduced in the walking mode by substantially conforming to the instep of the person wearing the amphibious shoe.

Still another object of the present invention is to provide an amphibious shoe having a fin structure that rests adjacent to the instep of the individual wearing the shoe structure thereby providing maximum comfort and flexibility in the walking mode.

A further object is to provide a web member constructed of highly flexible material for easy folding in the walking mode and provides ample propulsive forces in the swimming mode.

A still further object of the present invention is to provide a fin surface which can be transformed by introducing different materials and shapes thereby providing a variety of fin shapes, colors, water flow patterns and propulsive forces.

These and additional objects are provided by a convertible amphibious structure that provides a fin-like surface that expands for swimming and folds for walking to rest adjacent to the wearer's instep, the amphibious structure comprising:

a) a foot receiving structure having at least a frontal toe portion for receiving a foot;

b) a fin structure comprising two side fin arms, each side fin arm having a proximal and distal end, the proximal end positioned near the frontal toe portion;

c) pivot connector means for connecting the side fin arms to the frontal toe portion and for rotating the fin arms outwardly away from the wearer's instep to extend into a swimming mode position and for rotating the side fin arms inwardly towards the wearer's instep to retract into a walking mode position, the distal ends of the side fin arms diverge relative to one another when rotating outwardly and converge toward one another when rotating inwardly to rest adjacent to the wearer's instep.

The fin structure may further comprise a flexible web member that engages with the side fins arms and is of the configuration and size of the area generated by the expanded and diverged side fin arms. This flexible web member may be permanently attached to the side fin arms or be removable thereby providing the opportunity to modify the fin surface area by substituting colors and/or material types.

The convertible amphibious structure further provides for locking means to lock the fin structure in the extended swimming mode position and for unlocking when converting into the walking mode position.

Additional fin arms may be positioned between the side fin arms to provide additional structural integrity to the fin structure.

Another embodiment of the present invention is an amphibious shoe-like structure comprising:

a) a shoe-like structure comprising a frontal toe portion having a sole portion and an instep portion;

b) a fin structure comprising two slender side fin arms pivotally connected to opposing sides of the sole portion of the frontal toe portion. The side fin arms are adapted for diverging, relative to each other when extending outwardly for the swimming mode and converging inwardly when in the walking mode. The fin structure further comprises a web member secured to at least the side fin arms. The web member may be fabricated from a flexible sheet material and has the configuration and size to match the area between the side fin arms in the extended swimming mode position.

Another preferred embodiment of the present invention is an amphibious shoe-like structure which comprises:

a) a shoe-like structure having at least a frontal toe portion for receiving a foot, the frontal toe portion comprising a sole and instep portion;

b) a fin structure comprising:

i) two slender side fin arms of substantially equal length approximating the length of the instep portion of the shoe-like structure and pivotally connected to opposing sides of the sole portion, the side fin arms positioned at an angle for diverging outwardly from the sole portion in the extended swimming mode and converging inwardly for placement on the instep portion of the shoelike structure in the walking mode;

ii) a web member secured to at least the side fin arms, the web member being a flexible material, the web member being of the configuration and size matching the area between the side fin arms in the extended swimming mode, the web member having side means for engaging with the side fin arms thereby providing tension in the web member when the side fin arms are in the extended swimming mode position; and c) means for latchably locking said fin structure in the extended swimming mode and locking in the walking mode.

The fin structure while converging inwardly causes the concomitant folding or collapsing of the web member to reduce its overall and effective surface area. The folded web member conforms to the instep of the wearer and/or shoe structure thereby eliminating a cumbersome full size fin blade when walking. The web member can be removable or non-removable and constructed of any flexible sheet material selected from the group which comprises fabric, such as nylon, Dacron, canvas; plastic film; sheet polymeric materials, and/or any material that is durable and stiff enough to provide an adequate thrust force in water.

In accordance with the amphibious shoes of the present invention, the web member can be placed and/or secured over the fin arms while the fin arms are in the retracted or slightly retracted mode. When the fin arms are extended the web member is stretched between the fin arms thereby causing tension in the web member. The web member may be secured to the fin arms by bonding, sewing, lacing, heat sealing, or the like.

The above embodiments can further comprise means for attaching the fin structure to the instep portion of the shoe-like structure during the walking mode. Any means for securing the web member to the instep portion may be used including interlocking hook and eye fasteners, elastic hinges, snaps, buttons, and a combination thereof.

The above embodiments can further comprise at least one means for stopping the downward pivoting of the fin arms below the plane of the sole portion or beyond the extended swimming mode position, that being approximately perpendicular to the general axial direction of the wearer's lower leg. Any stopping means may be positioned on the fins arms and/or shoe structure to reduce downward movement of the fin arms.

Other objects, features, and advantages of the present invention will become apparent from a consideration of the following detailed description and from the accompanying drawings.

BRIEF DESCRIPTION OF THE DRAWINGS

FIG. 5 is a top plan view of another embodiment of the amphibious shoe of the present invention showing an additional fin arm in the fin structure.

FIG. 6 is a top plan view of FIG. 5 with the fin arms in the retracted walking mode position.

FIG. 14 is a cross-sectional fragmental view at line B—B of

FIGS. 1 and 5 with a spring-ball detent locking mechanism and fin arms in the extended swimming mode.

DESCRIPTION OF THE PREFERRED EMBODIMENT

Figure 1:
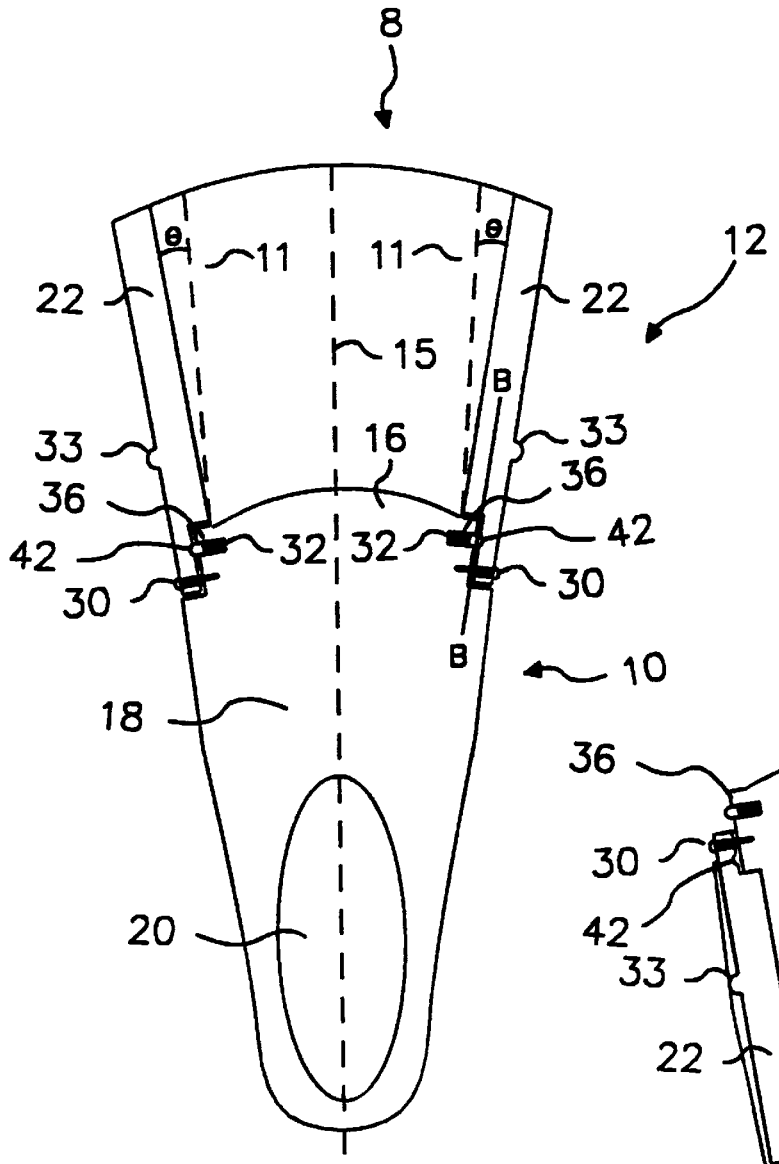
FIG. 1 is a top plan view of one embodiment of the amphibious shoe-like structure of the present invention with the side fin arms in the extended swimming mode position.
Figure 3:
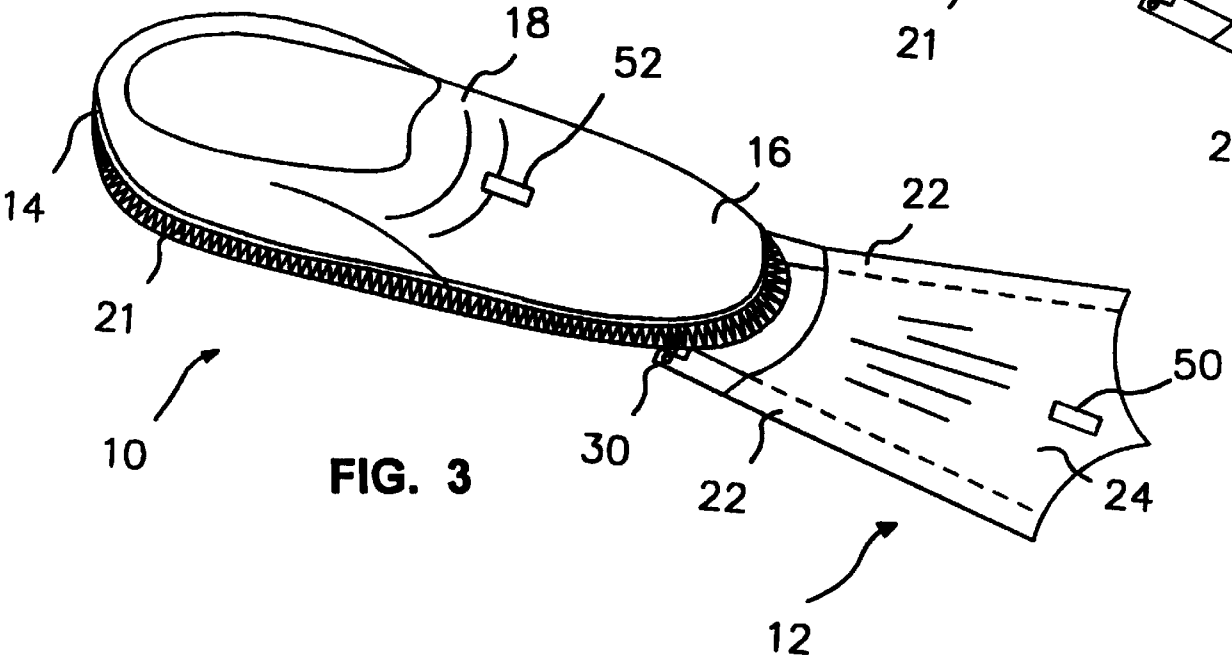
FIG. 3 is a perspective view of one embodiment of the amphibious shoe of the present invention with the web member attached to the fin arms in a fully extended mode position.

Referring now to the drawings and particularly FIGS. 1 and 3, there is illustrated a convertible amphibious shoe 8 having a shoe-like structure 10 for receiving the foot and a fin structure 12 extending therefrom. The shoe-like structure 10 comprises a protective heel portion 14, an instep portion 18, a frontal toe portion 16 and a bottom portion 20. The bottom portion 20 of the shoe-like structure 10 is adjacent and attached to an outer sole portion 21.

Shoe-like structure 10 may be fabricated as a one-piece composite structure and constructed of any flexible material having the characteristic of easily fitting over the foot forming a snug, but comfortable fit. Preferably, the flexible material includes neoprene rubber, an elastomeric material and any other natural or synthetic materials. It may be advantageous to fabricate the shoe from several different materials. Regarding the manner in which the shoe-like structure is attached to the user's foot, any style that provides comfort and ease of entry may be used, such as entrance through the heel portion or instep portion. The fit of the shoe-like structure should be tight enough so there is no sliding on the foot, but at the same time not so snug as to impede circulation and cause cramping.

The bottom portion 20, if applicable in the shoe style, may be attached to the outer sole 21 by any adhesive or bonding system that is well known in the art and which forms a bond between the two structures.

Outer sole portion 21 may be constructed of any resilient and flexible material that provides sufficient puncture protection from sharp objects yet offers sufficient flexibility while walking and swimming. This material may include various natural and synthetic rubbers; polymeric materials, such as silicone, polyethylene, polyester, polypropylene, polyurethane and so on; thermoplastic material and a composite material.

Shoe buoyancy may be a consideration when selecting an appropriate material for fabricating the amphibious shoe, understanding that this factor does not generally affect the quality or performance of the amphibious shoe. Materials having a density less than water may be considered for increased buoyancy. It is within the purview of a person skilled in the art to pick and choose among the foregoing material groups to achieve a specific result for a particular application.

Figure 4:
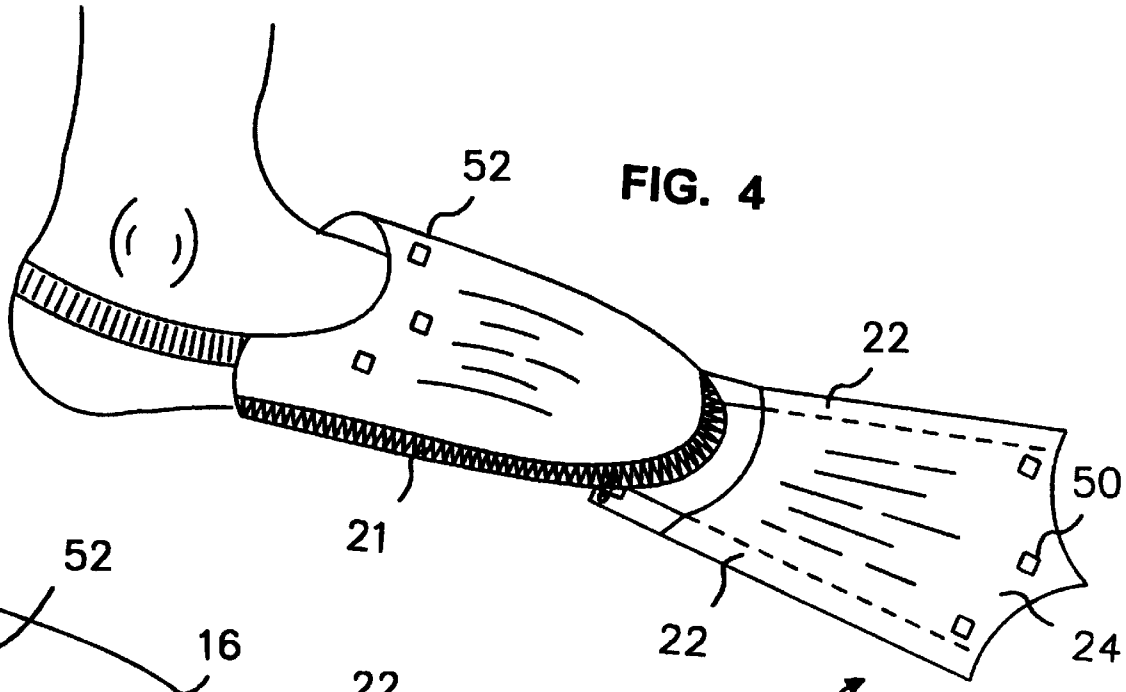
FIG. 4 is a perspective view of another preferred embodiment with a foot receiving pocket and the web member attached to the fins arms in a fully extended mode position.

The fin structure 12 as shown in FIGS. 3 and 4 comprises two side fin arms 22 that engage with and provide support for a web member 24. Each side fin arm has a proximal and distal end, the proximal end positioned near the frontal toe portion 16.

The side fin arms 22 are pivotally connected to the frontal toe portion of the shoe structure, and preferably to the outer sole 21 on opposite sides of the frontal toe of the shoe-like structure. The side fin arms may have an elongated and/or slender configuration and the length of each is predetermined by the approximate distance between the point of pivotal connection with the shoe structure and not exceeding the distance to the ankle of the user when retracted in the walking mode position. The configuration of the fin arms may be flat, rectangular, cylindrical or any other geometric shape.

Figure 13:
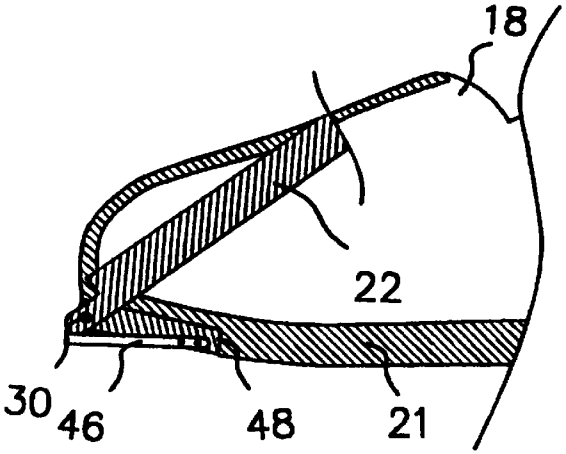
FIG. 13 is a cross-sectional fragmental view at line A—A of FIG. 7 with the fin structure in the fully retracted mode.

It is preferred that the side fin arms, when retracted in the walking mode position, are situated in an area on the shoe structure wherein they do not interfere with ambulatory motion. This can be accomplished by the converging of the side fin arms toward the instep portion of the shoe structure as they are rotated out of the extended swimming position into the walking mode position as shown in FIG. 13. Accordingly the side fin arms are positioned at an angle so that the distal ends of the side fin arms diverge, relative to one another, when pivoting outwardly to extend into the swimming mode and converge towards one another when pivoting inwardly to rest adjacent to the individual's instep for walking placement.

Figure 2:
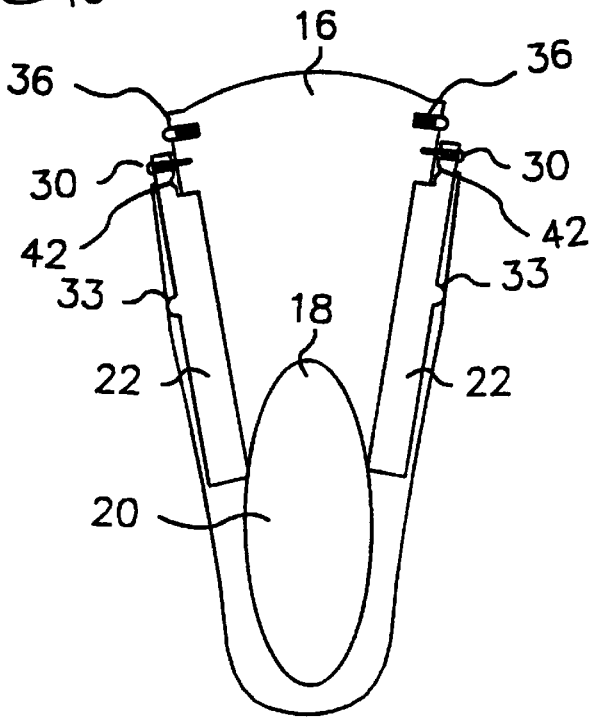
FIG. 2 is a top plan view of FIG. 1 with the side fin arms in the retracted walking mode position.
Figure 11:
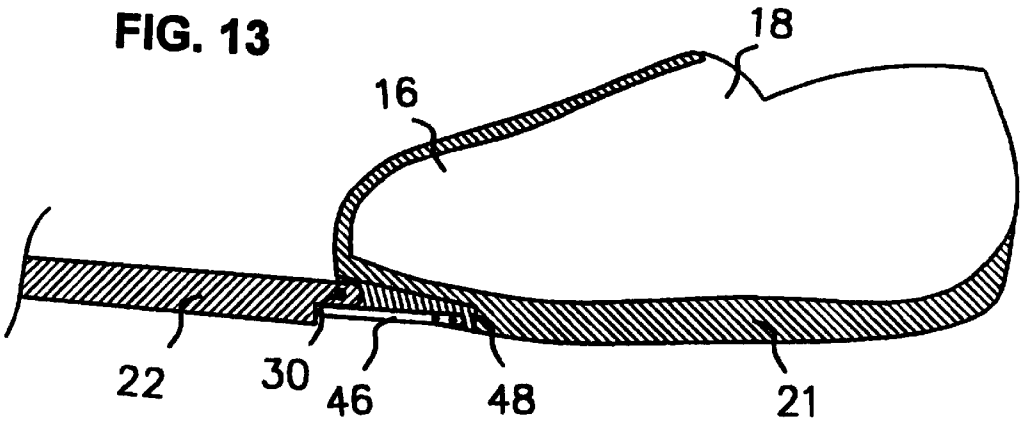
FIG. 11 is a cross-sectional fragmental view at line A—A of FIG. 7 with the fin structure in the extended swimming mode.

The side fin arms, because of the angle of placement in relation to the longitudinal axis 15 (shown in FIG. 1) of the shoe structure, can move together or apart depending on the angle of rotation on pivot pin 30. At zero degrees the side fin arms are fully extended and the distal ends of the side fin arms are separated at a maximum distance as shown in FIGS. 1 and 11. As the side fin arms rotate upwardly they converge towards each other and the distance between them diminishes as the fin arms are brought together. As the angle of rotation exceeds ninety degrees the fin arms approach the instep portion of the shoe-like structure for placement thereon. FIGS. 2 and 13 show the placement of the side fin arms in the walking mode position. The side fin arms are positioned at or near the instep portion of the shoe-like structure. In the rotation of the side fin arms, the area between the side fin arms is increased or decreased depending on whether the side fin arms are diverging outwardly away from each other in the extended swimming mode or converging inwardly in the retracted walking mode.

The orientation of the side fin arms 22 in the extended swimming mode may be positioned collinear to the longitudinal axis 15 of the amphibious shoe, and preferably, positioned at an angle 11 slightly greater than a collinear orientation with the longitudinal axis 15 of the sole portion as shown in FIG. 1. The angle 11 predetermines the overall surface area of the fin structure. The greater the angle relative to the longitudinal axis of the shoe, the greater the surface area of the web member in the extended position. However, there is a arc range wherein the optimal surface area of the fin is achieved while still allowing the side fin arms to converge over the instep portion of the shoe without crossing thereby permitting the fin arms to approach the instep portion for placement thereon. Preferably, angle 11 is greater than the collinear orientation with the longitudinal axis 15 of the shoe structure and less than 30 degrees, and more preferably, from about 10 to 20 degrees.

Figure 18:
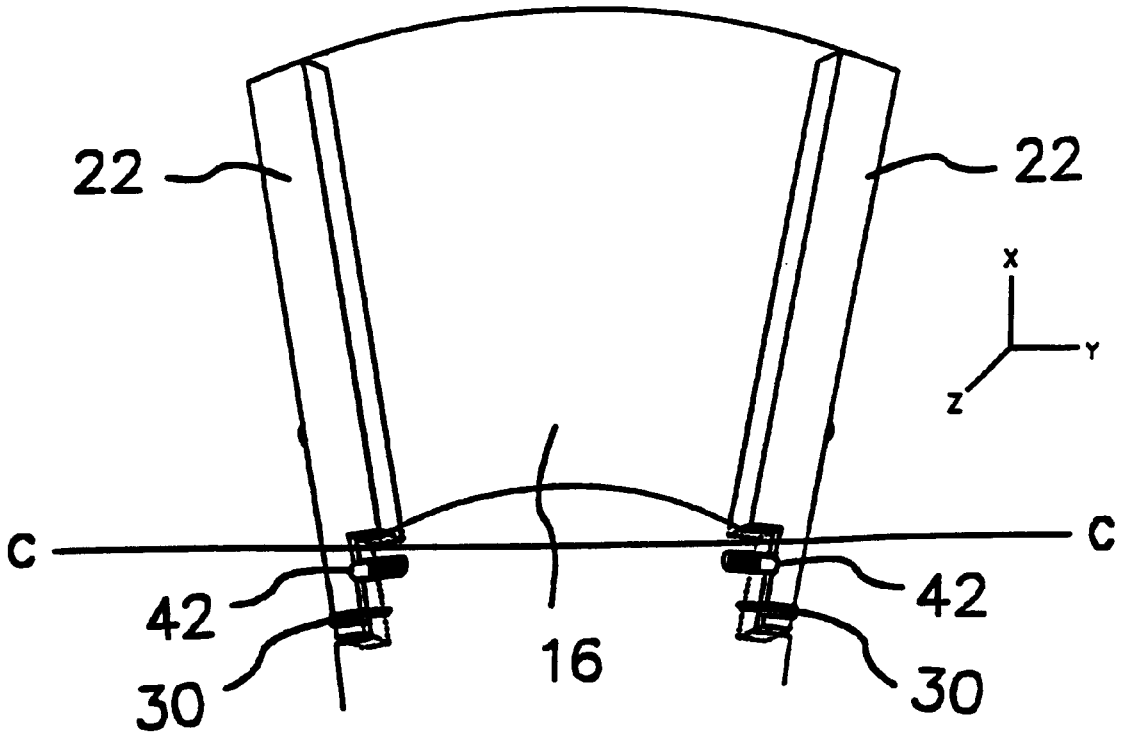
FIG. 18 is top plan view of positioning of the side fin arms having a compound angle alignment.
Figure 19:
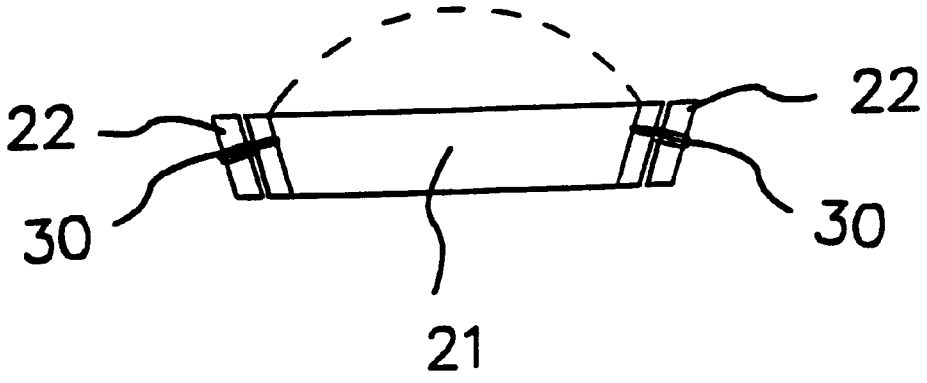
FIG. 19 is a cross-sectional fragmental view at line C—C of FIG. 18

As shown in FIGS. 18 and 19, it is further envisioned by the inventors that the side fin arms may be placed not only at a two-dimensional angle relative to the shoe structure, that being placement having an x and y directional component but also a three-dimensional angle with an x, y, and z directional component commonly referred to as a compound angle. This three dimensional angle may provide better alignment of the folded web member while resting adjacent to the instep of the shoe structure in the walking mode.

The side fin arms 22 are pivotally connected to the frontal toe portion of the shoe-like structure, that being any area between the arch of the user and toe portion, and preferably on the outer sole 21, by any pivoting means 30 that allows the side fin arms to rotate towards the instep of the shoe in at least a 90 degree radius, and preferably, between 0 and 160 degrees radius. Pivoting means 30 may include any stainless steel or plastic rivets, pins, screws, nut and bolt assemblies and a combination thereof. Preferably, a recessed screw-type pin having a shoulder for the fin arm to rotate thereon is secured directly into the sole portion 21.

The side fin arms 22 may be fabricated of any material that provides flutter flexibility in the fin structure while retaining some rigidity in the fin arms. Suitable materials may include rubber, plastic materials, other light weight synthetic materials, thin metallic strips, such as aluminum, molded plastic strips, fiber glass, and a combination thereof. When choosing the specific type of material for the fin arms, the degree of flexibility will determine the type of fins and respective capabilities, such as swimming-style or power-style. In general, having increased flexibility in a chosen material will reduce leg fatigue while increased rigidity tends to increase thrust.

The web member 24, shown in FIGS. 3 and 4, engages with the side fin arms 22 and provides a non-rigid fin blade surface in the walking mode and a sufficiently rigid webbing for propulsion in the swimming mode. To rigidize the web member, the fin arms are secured or locked into the extended position during the swimming mode. The locked orientation of the fin arms is such that when the fin arms are sufficiently expanded laterally, tension is applied to the web member thereby forming tension in the fin blade. The materials used to fabricate the web member may be nylon, Dacron, canvas, sheet polymeric material and/or any other flexible material that is foldable and/or collapsible.

The web member 24 of the amphibious shoe is attached to at least the side fin arms. Any means of fastening or securing the web member to the fin arms may be used, such as sewing, lacing, snaps, bonding, fabricated channels for receiving the fin arms, heat sealing or welding, and combinations thereof.

Figure 7:
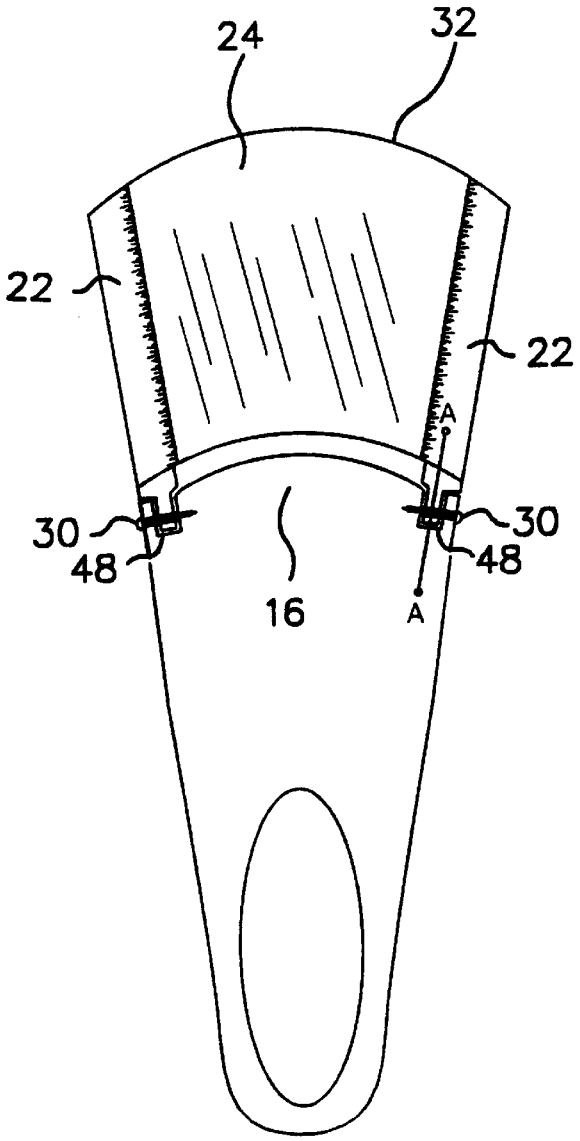
FIG. 7 is a top plan view of another embodiment of the amphibious shoe of the present invention with a locking lever mechanism used to secure the fin arms in the extended swimming mode position.
Figure 8:
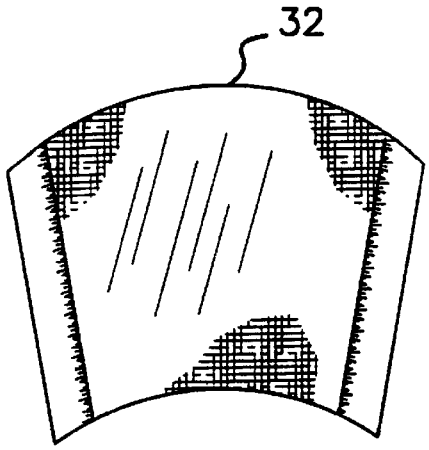
FIG. 8 is a top plan view of one embodiment of the web member of present invention.

The web member may be removable or non-removable depending on the method of attachment to the fin arms. As shown in FIG. 7, the web member is fabricated with stitched hem-like channels that receive the side fin arms. Likewise, the web member 24 shown in FIG. 5 is detachable and can be removed for replacement when necessary. The web member extends the length of the fin arms and is positioned adjacent to the toe portion of the shoe-like structure. Because, the web member, in the embodiment shown in FIG. 5, is not secured at the toe of the shoe there remains a venting space which permits the water to flow therethrough. It is believed that vented fins reduce fatigue and improve efficiency by letting water flow through the vents on the upward stroke, reducing resistance which enables more force on the downward stroke.

To insure correct placement of the web member without slippage on the fin arms, the web member may be further secured by retaining hooks 33 shown in FIG. 1. The web member may be adapted for receiving the retaining hooks 33.

It is further envisioned that the web member is not only secured to the fin arms but also to the frontal toe portion of the shoe structure. This embodiment will eliminate the vented fin structure. The web member has to be adapted for expansion to accommodate the toe portion of the shoe structure while in the walking mode. This may be accomplished by including additional material in the web member near the toe portion of the shoe structure which has the ability to expand by means such as tucking, pleating, or puckering of the material to accommodate the projecting toe portion. The web member may be attached by any means well known in the art, and preferably, heat sealed to the frontal toe portion and fin arms.

Figure 9:
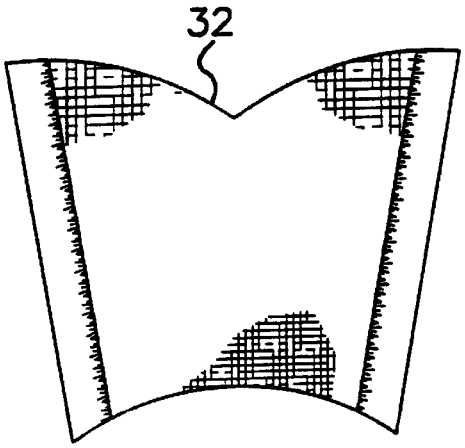
FIG. 9 is a top plan view of one embodiment of the web member of thee present invention showing a caudal fin shape.
Figure 10:
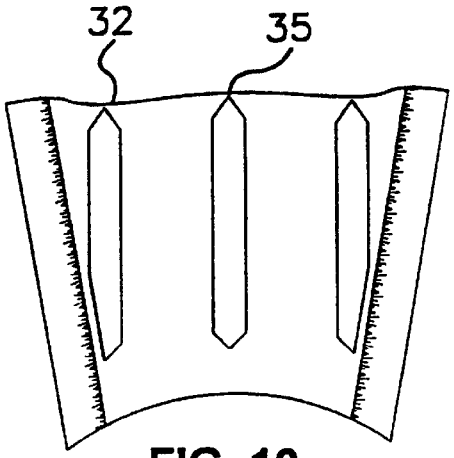
FIG. 10 is a top plan view of one embodiment of the web member of the present invention showing a raised pattern on the surface of the web member.

By the fact that the web member may be removed, several options are available to the user including materials having different textures, strength and/or colors. Furthermore, the present invention envisions several different web member shapes and surface patterns which may generate propulsion in different ways by redirecting the flow of water over the surface of the web member. For example, the terminus end 32 of the web member may take several different shapes to gain maximum thrust and efficiency in the water, such as a double concave arch as illustrated in FIG. 5. FIG. 9 illustrates a caudal or tail fin blade that offers a surface area resembling that of a fish, but still accommodates the folding of the web member onto the instep portion 18 of the amphibious shoe. FIG. 10 illustrates a plurality of ribs that may be positioned on the web member for increased strength and/or additional support. Preferably, at least two ribs 35 in the form of elevated ridges are positioned on the upper surface plane of the web member. The ribs 35 may be formed of a raised pattern of any material, and preferably polymeric material, stenciled, molded and/or coated onto the surface of the web member to control the web stiffness and flow of water over the surface during swimming.

Figure 14:
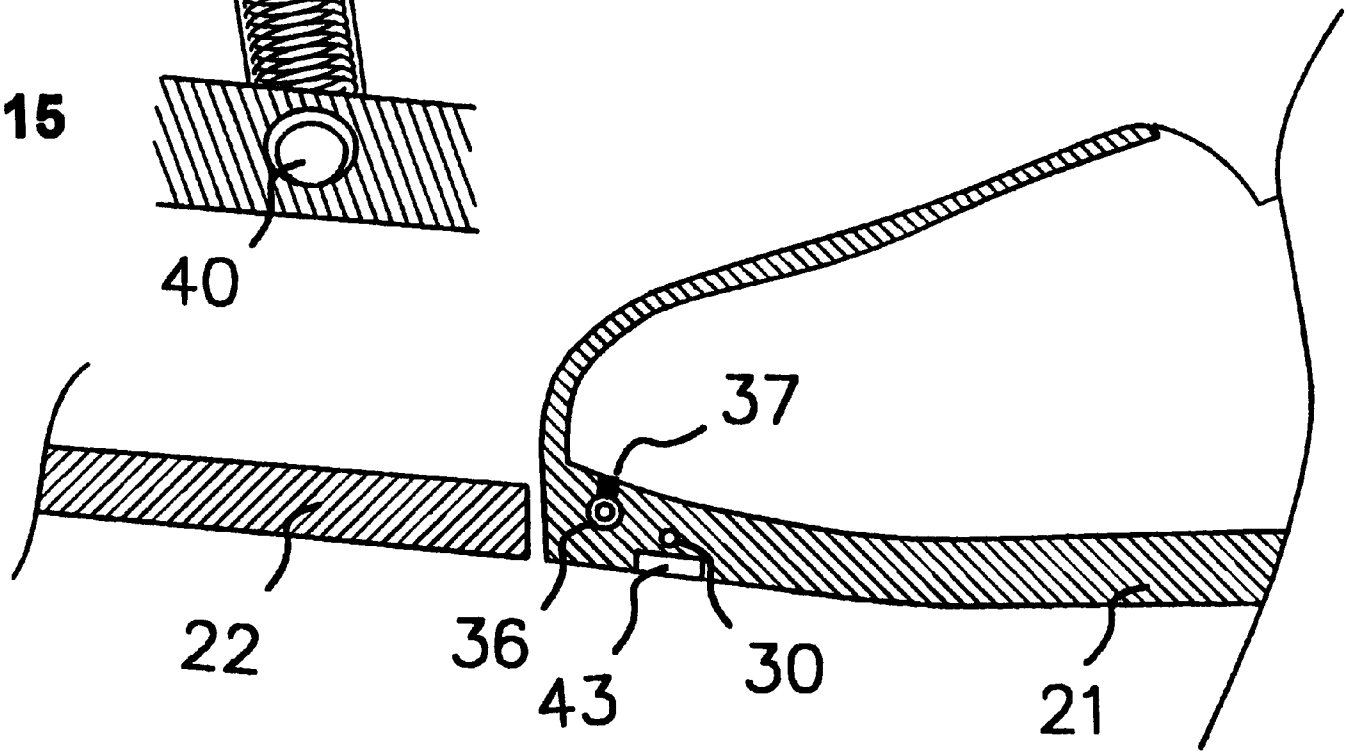
Figure 15:
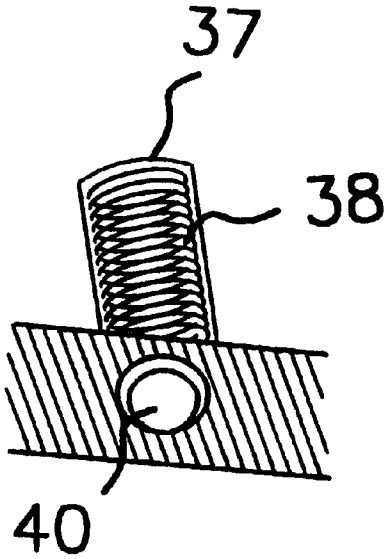
FIG. 15 is an enlarged cross-sectional fragmental view of FIG. 14 showing the bullet catch locking mechanism.

To maintain the fin structure in the swimming mode a locking system in addition to the pivot connector means must be implemented. Any latching device may be used that securely locks the fin structure in the extended swimming mode and releases to retract into the walking mode with applied pressure. Referring now again to the drawings, and particularly to FIGS. 1 and 7, there is illustrated a pair of locking means positioned on opposing sides of the amphibious shoe for securing the fin structure in the extended position and maintaining the side fin arms in their divergent orientation in the swimming mode. In the swimming mode, the fin structure is the surface that exerts propulsive forces which are transmitted from the user's leg motion. These forces can only be transmitted and exerted if the fin structure is stabilized and locked when in the extended swimming mode position. As such, a preferred locking means is a ball/bullet catch 36 as shown in FIGS. 1, 14 and 15. The ball/bullet catch which comprises a compression spring 38 and a ball or bullet shaped projection 40 which are embedded into a cylindrical recess 37 in the sole portion 21 of the shoe-like structure as shown in FIG. 14. A complementary recess 42 for receiving the ball/bullet projection 40 is positioned on the fin arms opposite the ball/bullet shaped projection. When the fin arms are being moved into the extended position, the ball/bullet projection 40 is initially pushed into the cylindrical recess 37 in the sole portion and the spring is momentarily compressed. Once the fin arms are fully extended the compression spring 38 forces the projection 40 into the complementary recess 42 as shown in FIGS. 1 and 2 and holds the fin structure in the extended swimming mode position. To insure that the fin structure will be maintained in the extended position, the force applied by the compression spring holding the ball/bullet projection in the complementary recess should exceed the upward and downward forces used in the swimming motion for propulsion. To unlock the ball/bullet catch mechanism, for retracting the fin structure into the walking mode, pressure must be applied to release the ball/bullet catch. This can best be accomplished by applying a pressure greater than that applied by the compression spring. This pressure will force the ball/bullet projection into the cylindrical recess against the compression spring and the fin arm will be released. This releasing pressure may be applied by the user applying an upward force on the fin arms.

The locking means and/or pivoting means may further comprise a stopping means 43, shown in FIG. 14, secured to either the sole portion and/or the fin arms to reduce and/or prevent the downward pivoting of the fin arms beyond the extended swimming mode position and/or below the plane of the sole of the shoe-like structure.

Figure 12:
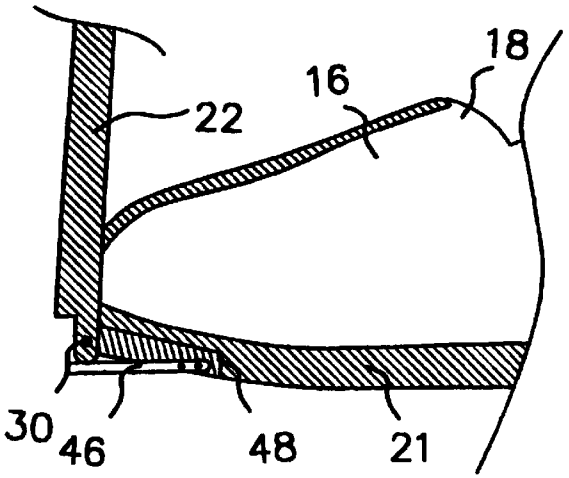
FIG. 12 is a cross-sectional fragmental view at line A—A of FIG. 7 with the fin structure in a partially retracted walking mode.

Another means for locking the fin structure in the extended swimming mode position is illustrated in FIGS. 7, 11, 12, and 13. In this embodiment the locking means is a locking lever which comprises a leaf spring 46 secured in an elongated recess 48 of the sole portion 21 of the shoe-like structure. The leaf spring 46, having a built-in internal upward force, acts as a locking lever that applies an upward force on the fins arms thereby locking the fins structure in the extended swimming mode position. To release the fin structure a downward pressure must be exerted on the leaf spring (See FIG. 12), that being greater than the internal upward force of the spring, to force the leaf spring in a downward position thereby allowing the fin arms to rotate into the retracted walking mode as shown in FIGS. 12 and 13. This releasing pressure may be applied by simply pulling on the tip of the fin structure and applying the appropriate upward force on the fin arms.

Figure 16:
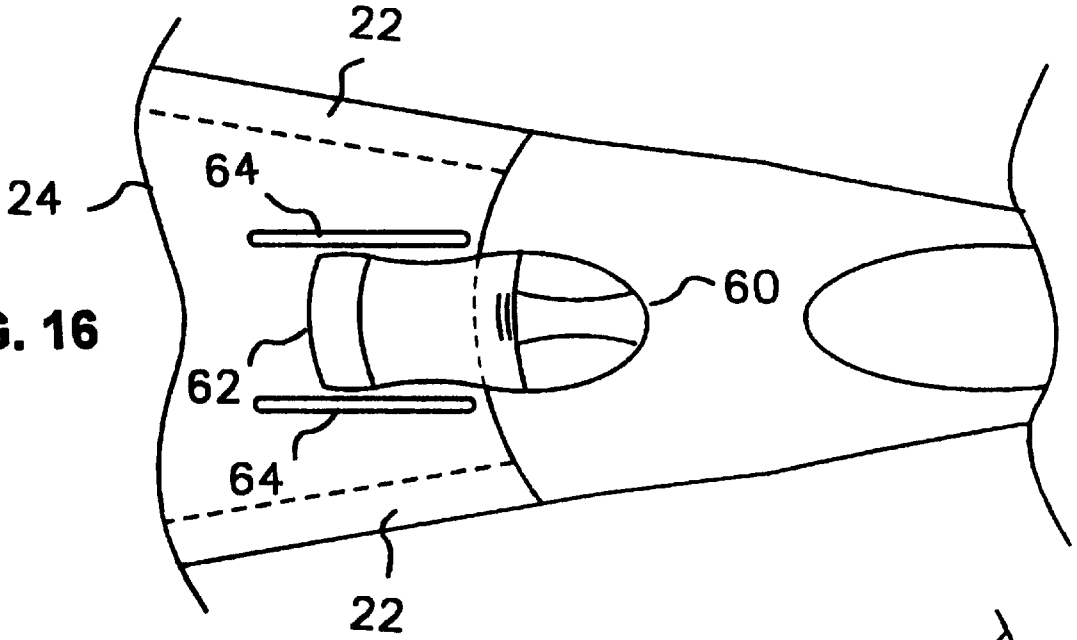
FIG. 16 is a top plan view of another embodiment of the amphibious shoe of the present invention with a rotating locking mechanism.
Figure 17:
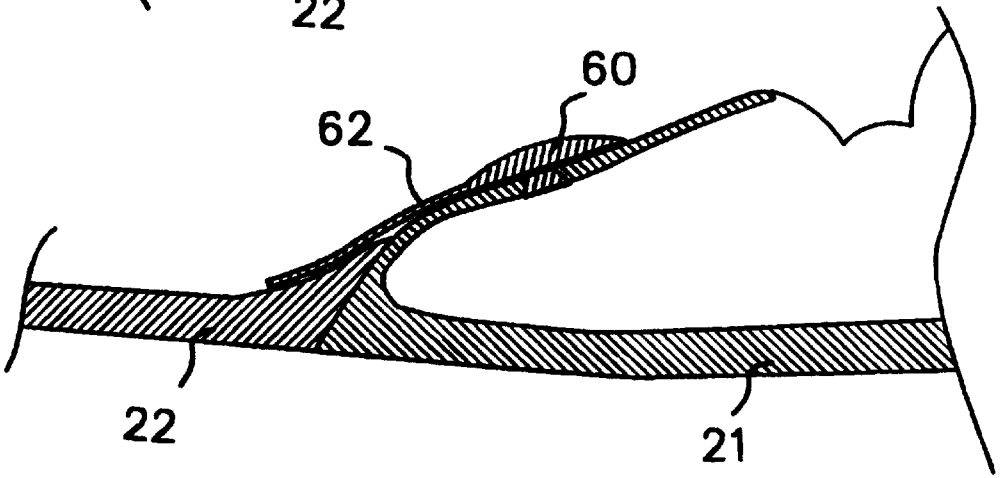
FIG. 17 is a cross-sectional fragmental side view of FIG. 16.

Another means for locking the fin structure in the extended swimming mode position is illustrated in FIGS. 16 and 17. In this embodiment the locking means is a rotating locking device which comprises a twist knob 60 and a rigid flap 62 attached thereto. The rigid flap bridges the gap between the shoe structure and fin structure. The fin member has at least two ridges 64 on the surface to serve to locate and secure the flap in the swimming mode position. The user rotates the twist knob to move the rigid flap off the web member thereby unlocking the fin structure and allowing the retraction of the fin structure into the walking mode. The knob and rigid flap may be made of any material more rigid than the material used for the web member.

Another preferred embodiment of the present invention is illustrated in FIGS. 5 and 6. The fin structure 12 is shown having a central fin arm situated between the two side fin arms positioned on opposing sides of the frontal toe portion. The central fin arm provides increased structural strength and integrity to the fin structure.

Any suitable means for attachment may be used to securely connect the fin structure 12 to instep portion 18 when converting the shoe from swimming mode to walking mode as shown in FIGS. 3 and 4. At least one band of conjugate hooked fabric 50 of the Velcro® type can be attached longitudinally onto the upper side of the web member 24 to engage with a complement band of conjugate hooked fabric 52 on instep portion 18 to securely affix the fin structure onto the outer surface of the instep portion of the amphibious shoe. At least one band of engaged conjugate hooked fabric provides a secure fastening of the fin blade while providing ample flexibility for walking. Other means of fastening may include snaps, clips, ties or any other conventional fastening means.

The amphibious shoe can be made in graduated sizes to fit all sizes of feet and the length of the fin structure should be determined by the respective size of the amphibious shoe. Preferably, the length of the fin structure should be approximately the length of the user's instep when the fin structure is positioned in the walking mode, as best illustrated by FIGS. 2, 6, and 13. The terminus end 32 of the fin arms and web member should be a distance from the toe portion of the shoe-like structure not exceeding that length which contacts a user's ankle when the fin structure engages with the shoe-like structure. This preferred length allows for easy and unencumbered walking without reducing flexibility of ankle movement.

The outer sole 21 may rise upward perpendicularly around the shoe-like structure a sufficient distance thereby forming a flange or bumper-like lip which encircles the entire shoe-like structure. This rising bumper-like lip provides additional protection for the foot when encountering rocks, coral or other sharp objects while walking on land or in shallow water. Additionally, the fin arms may be retain on the lip when positioned in the walking mode.

Numerous alterations of the structure herein disclosed will suggest themselves to those skilled in the art. It is apparent that various changes may be made in the construction and form of the present invention without departing from the spirit and scope of the invention, the forms hereinabove described being merely exemplary embodiments.

What is claimed is:

1. A convertible amphibious structure for walking and swimming, the structure comprising:

a) a shoe structure having at least a frontal toe portion for receiving a foot;

b) a fin structure that rests adjacent to a wearer's instep when walking and extends when swimming, the fin structure comprising two side fin arms, each side fin arm having a proximal and distal end, the proximal end positioned near the frontal toe portion;

c) pivot connector means for connecting the side fin arms to the frontal toe portion and for rotating the fin arms outwardly away from the wearer's instep to extend into a swimming mode position and for rotating the side fin arms inwardly towards the wearer's instep to retract into a walking mode position, the distal ends of the side fin arms diverge relative to one another when rotating outwardly and converge towards one another when rotating inwardly to rest adjacent to the wearer's instep.

2. The convertible amphibious structure according to claim 1 wherein the fin structure further comprises a flexible web member that engages with the side fin arms, the web member expands in the swimming mode and collapses in the walking mode.

3. The convertible amphibious structure according to claim 1 further comprising locking means for securing the fin structure in the extended swimming mode and for unlocking to position the fin structure in the walking mode.

4. The convertible amphibious structure according to claim 2 wherein the flexible web member is constructed of a flexible material selected from the group consisting of fabric and sheet polymeric materials, the web member being of the configuration and size to engage with the side fin arms and provide tension in the web member when the side fin arms are in the extended swimming mode.

5. The convertible amphibious structure according to claim 1 wherein the pivotally connected side fin arms are positioned at an angle relative to the longitudinal axis of the shoe structure for diverging outwardly in the extended swimming mode and converging inwardly when approaching the instep of the wearer in the walking mode.

6. The convertible amphibious structure according to claim 2 wherein the web member can be removable or non-removable.

7. The convertible amphibious structure according to claim 2 further comprising means for attaching the web member to the shoe structure during the walking mode.

8. The convertible amphibious structure according to claim 1 further comprising at least one stopping means for stopping downward pivoting of the side fin arms beyond the extended swimming mode position.

9. The convertible amphibious structure according to claim 1 wherein the fin arms are approximately the length of the instep of the wearer.

10. The convertible amphibious structure according to claim 1 wherein the frontal toe portion comprises a sole and instep portion and the side fin arms which are approximately the length of the instep portion are pivotally connected to opposing sides of the sole portion of the frontal toe portion.

11. The convertible amphibious structure according to claim 1 further comprising at least one fin arm positioned between the side fin arms.

12. An amphibious shoe structure that provides a fin surface that expands while in a swimming mode and collapses while in the walking mode to rest adjacent to the wearer's instep, the amphibious shoe structure comprising a) a foot receiving structure comprising at least a frontal toe portion for receiving a foot;

b) a fin structure pivotally connected to the frontal toe portion, the fin structure comprising a plurality of fin arms, the fin arms adapted to diverge and pivot outwardly to extend into a swimming mode position and to converge and pivot inwardly to rest adjacent to the wearer's instep in the walking mode.

13. The amphibious shoe structure according to claim 12 having two side fin arms diverging relative to one another when pivoting outwardly and converging toward one another when pivoting inwardly.

14. The amphibious shoe structure according to claim 12 wherein the fin structure further comprises a web member engaging with the fin arms that expands in the swimming mode and collapses in the walking mode thereby modifying the surface area of the web member.

15. The amphibious shoe structure according to claim 13 wherein the side fin arms are pivotally connected to opposing sides of the frontal toe portion and are positioned at an angle for diverging outwardly in an extended swimming mode and converging inwardly in a walking mode.

16. The amphibious shoe structure according to claim 12 further comprising means for locking said fin arms in the extended swimming mode and unlocking for the walking mode.

17. An amphibious shoe structure comprising:

a) a shoe structure having at least a frontal toe portion for receiving a foot, the frontal toe portion comprising a sole and instep portion;

b) a fin structure comprising:

i) at least two slender fin arms of substantially equal length approximating the length of the instep portion of the shoe structure and pivotally connected to opposing sides of the sole portion, the fin arms positioned at an angle for diverging outwardly away from the instep portion in the extended swimming mode and converging inwardly towards the instep portion of the shoe structure in the walking mode; and ii) a web member secured to at least the fin arms, the web member being a flexible material in the configuration and size of the area between the fin arms in the extended swimming mode, the web member having side means for engaging with the fin arms thereby providing tension in the web member when the fin arms are in the extended swimming mode position; and c) means for latchably locking said fin structure in the extended swimming mode and unlocking in the walking mode.

18. The amphibious shoe structure according to claim 17 wherein the web member is removable or non-removable.

19. The amphibious shoe structure according to claim 17 wherein the side fins arms are positioned at an angle less than 30° relative to the longitudinal axis of the shoe structure.

20. The amphibious shoe structure according to claim 17 further comprising at least one stopping means for stopping downward pivoting of the fin arms beyond the extended swimming mode position.

* * * * *